United States Patent [19]

Iino et al.

[11] Patent Number: 4,801,515

[45] Date of Patent: Jan. 31, 1989

[54] PHOTOSENSITIVE MEMBER HAVING AN OVERCOAT LAYER

[75] Inventors: Shuji Iino, Hirakata; Hideo Hotomi, Suita; Masanori Fujiwara, Osaka; Isao Doi, Toyonaka; Izumi Osawa, Ikeda, all of Japan

[73] Assignee: Minolta Camera Kabushiki Kaisha, Osaka, Japan

[21] Appl. No.: 69,516

[22] Filed: Jul. 2, 1987

[30] Foreign Application Priority Data

Jul. 8, 1986 [JP] Japan ..... 61-160228
Jul. 8, 1986 [JP] Japan ..... 61-160229
Jul. 8, 1986 [JP] Japan ..... 61-160230

[51] Int. Cl.[4] ..... G03G 5/14

[52] U.S. Cl. ..... 430/66; 430/57; 430/85

[58] Field of Search ..... 430/56, 58, 66, 84, 430/95, 57, 85

[56] References Cited

U.S. PATENT DOCUMENTS

| | | | |
|---|---|---|---|
| 3,956,525 | 5/1976 | Yasuba | 427/41 |
| 4,366,208 | 12/1982 | Akai et al. | 428/421 |
| 4,394,425 | 7/1983 | Shimiza et al. | 430/65 |
| 4,430,404 | 2/1984 | Hosoya et al. | 430/58 |
| 4,490,450 | 12/1984 | Shimizu et al. | 430/57 |
| 4,559,289 | 12/1985 | Sunagawa et al. | 359/53 |
| 4,634,648 | 1/1987 | Jansen et al. | 430/95 |
| 4,675,265 | 6/1987 | Kazami et al. | 430/67 |

FOREIGN PATENT DOCUMENTS

| | | |
|---|---|---|
| 50-30526 | 3/1975 | Japan . |
| 51-46130 | 4/1976 | Japan . |
| 53-23636 | 3/1978 | Japan . |
| 53-111734 | 9/1978 | Japan . |
| 54-115134 | 9/1979 | Japan . |
| 55-86169 | 6/1980 | Japan . |
| 56-000751 | 7/1981 | Japan . |
| 57-64239 | 4/1982 | Japan . |
| 58-139154 | 8/1983 | Japan . |
| 59-58437 | 4/1984 | Japan . |
| 59-58432 | 4/1984 | Japan . |
| 60-101541 | 6/1985 | Japan . |
| 60-249155 | 12/1985 | Japan . |
| 61-94056 | 5/1986 | Japan . |

OTHER PUBLICATIONS

Journal of Applied Polymer Science, vol. 17, 1973.
"A C-nmr Investigation of Plasma Polymerized Ethane, Ethylene, and Acetylene", Dilks et al, Journal of Polymer Science, vol. 19, 1981.

*Primary Examiner*—John L. Goodrow
*Attorney, Agent, or Firm*—Burns, Doane, Swecker & Mathis

[57] ABSTRACT

A photosensitive member of the present invention comprises an electrically conductive substrate, a photoconductive layer and an overcoat layer.

The photoconductive layer comprises selenium-arsenic alloy layer, or selenium layer and selenium-tellurium layer formed in this order. The overcoat layer comprises amorphous carbon containing hydrogen and contains a kind of atom selected from the group consisting of halogen, oxygen and nitrogen.

The photosensitive member of this construction is harmless and excellent in electrophotographic characteristics inclusive of durability and surface hardness.

8 Claims, 3 Drawing Sheets

PHOTOSENSITIVE MEMBER HAVING AN OVERCOAT LAYER

BACKGROUND OF THE INVENTION

1. Field of the Invention

The present invention relates to a photosensitive member comprising a surface protective layer on a monolayer construction of selenium-arsenic alloy or a laminate-layer construction of selenium-tellurium alloy.

2. Description of the Prior Art

Remarkable developments have continued to be made in the application of electrophotographic techniques since the invention of the Carlson process. Various materials have also been developed for use in electrophotographic photosensitive members.

Conventional photoconductive materials chiefly include inorganic compounds such as selenium, selenium-arsenic, selenium-tellurium, cadmium sulfide, zinc oxide, amorphous silicon, and organic compounds such as polyvinylcarbazole, metal phthalocyanine, dis-azo pigments, tris-azo pigments, perillene, triphenylmethanes, triphenylamines, hydrazones, styryl compounds, pyrazolines, oxazoles, oxydiazoles and the like.

The trend toward increasing volumes of information in a variety of fields has been remarkable in recent years and it has become necessary to develop high speed electrophotographic systems in order to duplicate high-volume information in a short time. High-sensitivity photoconductive materials are required in such high-speed copy systems, and among the aforementioned compounds, photosensitive members composed of selenium-arsenic alloys (hereinafter referred to as Se-As) are the most physically sensitive in spectral luminous efficiency with many compounds finding practical applications. Other compounds have various inadequacies in regard to sensitivity and have not been adapted for use in high-speed copy systems.

Laser beam printers using semiconducting laser beams as a light source have become practical in recent years accompanying the remarkable developments in digital image processing technology, and these systems also need increased speed. An ideal photosensitive member having satisfactory sensitivity for the light emission wavelengths of semiconductor lasers is a so-called selenium-tellurium (hereinafter referred to as Se-Te) member comprising, from among the aforementioned compounds, a selenium layer having a selenium-tellurium layer laminated thereon.

However, conventional Se-As and Se-Te photosensitive members in common use have the following disadvantages. One disadvantage is that they are harmful to the human body. Although it is nearly impossible for the photosensitive member to come into direct contact with the human body, when such a photosensitive member is used in a copy machine, powder from said member adheres to the copy image due to surface friction caused by the member rubbing against the copy paper, cleaning materials, developer or other matter, and the powder is then discharged from the machine. Accordingly, when the copy is picked up by hand the person is directly contaminated by the selenium, arsenic and tellurium, the harmfulness of said substances being a matter for concern. Another disadvantage is poor durability. The surface hardness of Se-As and Se-Te photosensitive members barely meets the H level of the JIS standards for pencil lead hardness; consequently, the surface is readily damaged when friction is generated during use of the machine as described previously, or repeated harsh surface contact is made during paper jams and the resultant reversion to manual remedies. This damage markedly reduces the image quality due to so-called whiteouts on the copy image, and shortens the useful life span of the photosensitive material. Although the useful life span of the photosensitive member varies according to the design of the copy machine within which it is incorporated, it should normally be good for 100,000 copies. In high-speed, high-volume copy machines, a short useful life span necessitates replacement of the photosensitive member or frequent maintenance, resulting in a reduction in the efficient use of the copy machine.

In order to eliminate these disadvantages, the surface of the Se-As or Se-Te photosensitive member is covered with a protective layer, thus avoiding direct contact between the photosensitive layer and the copy paper and preventing harmful material from being discharged from the machine. Moreover, using a hard film on said protective layer is an effective method for improving wear and abrasion resistance.

Not all film material can be used to cover the surface of the Se-As or Se-Te photo-sensitive member; film material which fulfills all the following criteria must be used, and new contributions are required for the film material as well as the film-forming means.

Firstly, a film is required which can fully guarantee the amount of incident light to the Se-As or Se-Te photosensitive member, and which is capable of utilizing the high sensitivity of these photosensitive members. Secondly, a hard film is required which will not receive damage to its surface when it is put to actual use in a copy machine. Thirdly, a film is required which has superior adhesive properties in regard to adhesion to the Se-As or Se-Te photosensitive member, and which will not separate from said photosensitive member due to mechanical forces or changes in temperature or humidity when put to actual use in a copy machine. Fourthly, the film must be made of harmless materials. Fifthly, a film is required which does not have an electrical consistency superior to that of the Se-As or Se-Te photosensitive member, does not produce a residual electric potential or a so-called memory image wherein a previous image is formed over a subsequent image as either a positive or negative image during the multiple copy process, and which does not participate in the production of so-called image drift induced by charge drift on a mismatching interface. Sixthly, the film must not cause a loss of image quality or produce so-called image drift when the copy machine is in actual use or under environmental conditions of high temperature and humidity.

From these perspectives, many film materials as well as film-forming means related to surface protective layers for not only Se-As and Se-Te photosensitive members but also selenium series photosensitive members have been disclosed, thus becoming an important field of electrophotographic technology.

One means for forming the protective layer is the application method. For example, Unexamined Japanese Patent Publication No. Sho 50-30526 discloses a polyurethane overcoat layer of a 0.5 to 2.5 μm thickness applied or sprayed on the surface of a photo-sensitive member of a CdSSe and ZnO compound. Unexamined Japanese Patent Publications Nos. Sho 53-23636 and Sho 53-111734 disclose photosensitive members having a specific silicide applied on selenium, selenium-tellurium alloy, and selenium-cadmium alloy photoconductive layers and hardened to form an insulating layer. Unexamined Japanese Patent Publication No. Sho 54-115134 discloses a photosensitive member having a selenium photoconductive layer formed on a substrate except at both ends, said selenium photoconductive layer having only a resin layer formed thereon by immersion application and hardening.

These disclosures attempt to resolve the aforesaid disadvantages by applying and hardening organic compounds to the surface of a selenium series photosensitive member, as do similar disclosures in Unexamined Japanese Patent Publications Nos. Sho 57-64239, Sho 58-139154 and Sho 60-101541.

In recent years another method has been experimentally applied to vacuum film formation by the glow discharge process. For example, Unexamined Japanese Patent Publication No. Sho 59-58437 discloses a photosensitive member having an amorphous Si:N or Si:O layer of 50 angstroms to 2 μm in thickness formed on a selenium-arsenic alloy layer by the glow discharge process using silane gas and ammonia gas, or silane gas and nitrous oxide gas as starting materials. Unexamined Japanese Patent Publication No. Sho 60-249155 discloses a photosensitive member having an amorphous carbon or hard carbon layer of 0.05 to 5 μm thickness formed on a photosensitive layer by a glow discharge process using methane or acetylene as the starting materials.

In these publications, however, there is no disclosure of any means for resolving the basic disadvantages inherent in the aforementioned Se-As and Se-Te photosensitive members.

SUMMARY OF THE INVENTION

A principal object of the present invention is to provide a non-injurious photosensitive member generally superior in electrophotographic characteristics and having high durability.

Another object of the invention is to provide a photosensitive member which does not produce a residual electric potential and is capable of effectively preventing the occurrence of a so-called memory image wherein a previous image appears on a subsequent image during the multiple copy process.

Still another object of the invention is to provide a surface protective layer of high hardness which has superior adhesion properties on the photosensitive member.

A further object of the invention is to provide a photosensitive member having a surface protective layer which does not separate from said member when put into actual service in a copy machine.

A still further object of the present invention is to provide a photosensitive member which does not cause a loss of image quality or produce so-called image drift under conditions of high temperature and humidity.

An even further object of the present invention is to provide a hhotosensitive member having a monolayer construction of selenium-tellurium-arsenic alloy (Se-As), or a laminate-layer construction of selenium and selenium-tellurium alloy (Se-Te), said layer being characterized by high visible light transmittance, and a surface protective layer which can fully guarantee the amount of incident light to the Se-As or Se-Te photosensitive member.

These and other objects of the present invention are achieved by providing a photosensitive member comprising a conductive substrate, a photosensitive layer formed by a selenium-arsenic alloy monolayer, or selenium and selenium-tellurium alloy layers formed in sequence, and an amorphous carbon surface protective layer (overcoat layer) provided over the photosensitive layer, said surface protective layer comprising one type of atom from the group of halogen, oxygen and nitrogen.

DETAILED DESCRIPTION OF THE INVENTION

Figure 1:
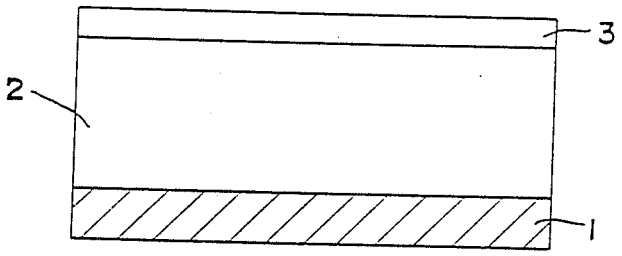
FIG. 1 shows the basic structure of the photosensitive member according to the present invention.

The present invention relates to an Se-As or Se-Te photosensitive member characterized by a protective layer formed thereon, said protective layer comprising an amorphous hydrocarbon layer having one type of atom from the group formed by halogen, oxygen and nitrogen formed of a glow discharge process in a low pressure vacuum (the amorphous hydrocarbon layer being hereinafter referred to as the a-C layer).

The present invention employs a gaseous mixture of hydrocarbon and halogen or oxygen or nitrogen as the starting materials for forming the a-C layer via a glow discharge process, and also uses common hydrogen or argon gas as a carrier.

These hydrocarbons need not always be in a gaseous phase at room temperature and atmospheric pressure, but can be in a liquid or solid phase insofar as they can be vaporized as by melting, evaporation or sublimation, for example, with heating or in a vacuum. Examples of these hydrocarbons are saturated hydrocarbons, unsaturated hydrocarbons, alicyclic hydrocarbons, aromatic hydrocarbons and the like.

A wide variety of hydrocarbons are usable. Examples of useful saturated hydrocarbons are normal paraffins, such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, heptacosane, octacosane, tricosane, tetracosane, pentadosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, and the like.

Examples of useful unsaturated hydrocarbons are olefins, such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methylallene, butadiene, pentadiene, hexadiene, cyclopentadiene, and the like; triolifins such as ocimene, alloocimene, myrcene, hexatriene, and the like; and alkynes such as acetylene, methylacetylene, 1-butyne, 2-butyne, 1-pentyne, 1-hexyne, 1-heptyne, 1-octyne, 1-nonyne, 1-decyne, and the like.

Examples of useful hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, and the like; cycloolifins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinen, sesquibenihene, selinene, caryophyllene, santalene, cedrene, camphorene, phyllocladene, podocarpene, mirene and the like; steriods, etc.

Examples of useful aromatic hydrocarbons are benzene, toluene, xylene, hemimellitene, pseudocumene, mesitylene, prehnitene, isodurene., durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. Among the aforementioned hydrocarbons the most desirable are butadiene and propylene.

The a-C layer of the present invention contains 30 to 60 atomic % of hydrogen atoms based on the combined amount of carbon and hydrogen atoms present.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, i.e., the hydrocarbon gases, applying a greater power, decreasing the frequency of the alternating electric field to be set up or increasing the intensity of a d.c. electric field superposed on the alternating electric field.

A gaseous halogen mixture may be used in the present invention in addition to the hydrocarbon gases to add halogen atoms to the a-C layer. The halogen atoms may be fluorine atoms, chlorine atoms, bromine atoms and iodine atoms. The aforesaid gaseous halogen mixture need not necessarily be in the gaseous phase at room temperature and atmospheric pressure, but can be in a liquid or solid phase insofar as they can be vaporized as by melting, evaporation or sublimation via heating or in a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodine chloride, hydrogen bromide, iodine bromide, hydrogen iodide, and the like; and organic compounds such as alkyl halides, alkylmetal halides, allyl halides, halogenated silicic esters, stylene halides, polymethylene halides, halogen substituted organosilanes, haloform, and the like.

Examples of useful alkyl halides are methyl fluoride, methyl chloride, methyl bromide, methyl iodide, ethyl fluoride, ethyl chloride, ethyl bromide, ethyl iodide, propyl fluoride, propyl chloride, propyl bromide, propyl iodide, butyl fluoride, butyl chloride, butyl bromide, butyl iodide, amyl fluoride, amyl chloride, amyl bromide, amyl iodide, hexyl fluoride, hexyl chloride, hexyl bromide, hexyl iodide, heptyl fluoride, heptyl chloride, heptyl bromide, heptyl iodide, etc.; examples of alkylmetal halides are dimethylaluminum chloride, dimethylaluminum bromide, diethylaluminum chloride, diethylaluminum iodide, methylaluminum dibromide, ethylaluminum diiodide, trimethyltin chloride, trimethyltin bromide, trimethyltin iodide, triethyltin chloride, triethyltin bromide, dimethyltin dichloride, dimethyltin dibromide, dimethyltin diiodide, diethyltin dichloride, diethyltin dibromide, diethyltin diiodide, methyltin trichloride, methyltin tribromide, methytin triiodide, methyltin tribromide, methyltin triiodide, ethyltin tribromide, and the like. Examples of useful allyl halides are fluorobenzene, chlorobenzene, bromobenzene, iodobenzene, chlorotoluene, bromotoluene, chloronaphthalene, bromonaphthalene, etc.; examples of halogenated silicic esters are monomethoxytrichlorosilane, dimehhoxydichlorosilane, trimethoxymonochlorosilane, monoethoxytrichlorosilane, diethoxydichlorosilane, triethoxymonochlorosilane, monoallyloxytrichlorosilane, diallyloxydichlorosilane, triallyloxymonochlorosilane, etc.; examples of styrene halides are chlorostyrene, bromostyrene, iodostyrene, fluorostyrene, and the like. Useful examples of polymethylene halides are methylene fluoride, methylene fluoride, methylene bromide, methylene iodide, ethylene chloride, ethylene bromide, ethylene iodide, trimethylene chloride, trimethylene bromide, trimethylene iodide, dichlorobutane, dibromobutane, diiodobutane, dichloropentane, dibromopentane, diiodopentane, dichlorohexane, dibromohexane, diiodohexane, dichloroheptane, dibromoheptane, diiodoheptane, dichlorooctane, dibromooctane, diiodooctane, dichlorononane, dibromononane, and the like. Useful examples of halogen substituted organosilanes are chloromethyltrimethylsilane, dichloromethyltrimethylsilane, bis(chloromethyl)dimethylsilane, tris(chloromethyl)methylsilane, chloroethyltriethylsilane, dichloroethyltriethylsilane, bromomethyltrimethylsilane, iodomethyltrimethylsilane, bis(iodomethyl)dimethylsilane, chlorophenyltrimethylsilane, bromophenyltrimethylsilane, chlorophenyltriethylsilane, bromophenyltriethylsilane, iodophenyltriethylsilane, etc.; examples of haloforms are fluoroform, chloroform, bromoform, iodoform, and the like.

In the present invention, gaseous oxygen compounds may be used in addition to the aforesaid hydrocarbon gas mixture for the minimum purpose of adding oxygen atoms to the a-C layer. The aforesaid gaseous oxygen mixture need not necessarily be in the gaseous phase at room temperature and atmospheric pressure, but can be in a liquid or solid phase insofar as it can be vaporized as by melting, evaporation or sublimation via heating or in a vacuum. While oxygen and ozone are usable for this purpose, examples of useful oxygen compounds are water vapor, carbon monoxide, carbon dioxide, carbon suboxide, etc., and organic compounds having heterocyclic functional radicals containing oxygen or oxygen-containing bonds such as the hydroxyl radical (—OH), aldehyde radical (—COH), acyl radical (RCO—, —CRO), ketone radical (≧CO), ether bond (—O—), ester bond (—COO—), and the like. Among the useful organic compounds having the hydroxyl radical are methanol, ethanol, propanol, butanol, allyl alcohol, fluoroethanol, fluorobutanol, phenol, cyclohexanol, benzyl alcohol, furfuryl alcohol, etc. Among the organic compounds which may be used having an aldehyde radical are, for example, formaldehyde, acetaldehyde, propionaldehyde, butylaldehyde, glyoxal, acrolein, benzaldehyde, furfural, and the like. Useful organic compounds having an acyl radical are, for example, formic acid, acetic acid, propionic acid, butyric acid, valeric acid, palmitic acid, stearic acid, oleic acid, oxalic acid, malonic acid, succinic acid, benzoic acid, toluic acid, salicylic acid, cinnamic acid, naphthoic acid, phthalic acid, furoic acid, etc. Useful organic compounds having a ketone radical are, for example, acetone, ethyl methyl ketone, methyl propyl ketone, butyl methyl ketone, pinacolone, diethyl ketone, methyl vinyl ketone, mesityl oxide, methyl heptanone, cyclobutanone, cyclopentanone, cyclohexanone, acetophenone, propiophenone, butylphenone, valerophenone, dibenzyl ketone, acetonaphthone, acetophenone, acetylfuran, and the like. Examples of useful organic compounds having ether bonds are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ether amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyrane, dioxane, and the like. Useful organic compounds having ester bonds are, for example, methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate, and the like. Examples of useful heterocyclic compounds containing oxygen are furan, oxyzole, furazan, pyrane, oxazine, morpholine, benzofuran, benzoxazole, chroman, dibenzofuran, xanthene, phenoxanthene, oxirane, dioxirane, oxathiorane, oxadiazine, benzoisoxazole, and the like.

In the present invention, gaseous nitrogen compounds may be used in addition to the aforesaid hydrocarbon gas mixture for the minimum purpose of adding nitrogen atoms to the a-C layer. The aforesaid gaseous nitrogen mixture need not necessarily be in the gaseous phase at room temperature and atmospheric pressure, but can be in a liquid or solid phase insofar as it can be vaporized as by melting, evaporation or sublimation via heating or in a vacuum. The nitrogen compound may be any of a number of inorganic compounds such as, for example, ammonia, nitrogen monoxide, nitrogen dioxide, dinitrogen trioxide, dinitrogen pentoxide, nitrogen trioxide, etc., and may be any of a number of organic compounds having heterocyclic functional groups containing nitrogen or nitrogen-containing bonds such as the amino radical (—$NH_2$), cyano radical (—CN), nitro radical (—$NO_2$), nitroso radical (—NO), isocyanic ester bonds (—NCO), isothiocyanic ester bonds (—NCS), azothio ether bonds (—N=NS—), peptide bonds (—CONH—), and the like. Examples of useful organic compounds having amino radicals are methylamine, ethylamine, propylamine, butylamine, amylamine, hexylamine, heptylamine, octylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, aniline, methylaniline, dimethylaniline, ethylaniline, diethylaniline, toluidine, benzylamine, dibenzylamine, tribenzylamine, diphenylamine, triphenylamine, naphthylamine, ethylene diamine, trimethylene diamine, tetramethylene diamine, pentamethylene diamine, hexamethylene diamine, diaminoheptane, diaminooctane, phenylene diamine, and the like. Some useful organic compounds having cyano radicals are, for example, acetonitrile, propionitrile, butyronitrile, valeronitrile, capronitrile, enantonitrile, capryronitrile, ferralgonitrile, caprynitrile, lauronitrile, palmitonitrile, stearonitrile, crotononitrile, malononitrile, succinonitrile, glutaronitrile, adiponitrile, benzonitrile, tolunitrile, cyanobenzylic cinnamonitrile, naphthonitrile, cyanopyridine, and the like. Useful organic compounds having nitro radicals are, for example, nitrobenzene,nitrotoluene, nitroxylene, nitronaphthalene, etc. Examples of organic compounds having nitroso radicals which may be used are nitrosobenzene, nitrosotoluene,-nitrosocresol, nitrosonaphthalene, etc. Some organic compounds having isocyanic ester bonds are, for example, methyl isocyanate, ethyl isocyanate, propyl isocyanate, butyl isocyanate, phenyl isocyanate, naphthyl isocyanate, etc. Useful organic compounds having isothiocyanic ester bonds are, for example, methyl isothiocyanate, ethyl isothiocyanate, propyl isothiocyanate, butyl isothiocyanate, amyl isothiocyanate, allyl isothiocyanate, phenyl isothiocyanate, benzyl isothiocyanate, and the like; examples of organic compounds having azothio ether bonds are benzenediazothiophenyl ether, chlorobenzenediazothiophenyl ether bromobenzeneazothiophenyl ether, nitrobenzenediazothiophenyl ether, phenyldiazomercaptonaphthalene, methoxyphenyldiazomercaptonaphthalene, benzenediazothioglycollic acid, bromobenzenediazothioglycollic acid, nitrobenzenediazothioglycollic acid, and the like. Some examples of useful organic compounds having peptide bonds are α-D-glucoheptitol, β-D-glucoheptitol, and the like. Useful heterocyclic compounds are, for example, pyrrole, pyrroline, pyrrolidine, oxazole, thiazole, imidazole, imidazoline, imidazoledine, pyrazole, pyrazoline, pyrazoledine, triazole, tetrazole, pyridine, piperidine, oxazine, morpholine, thiazine, pyridazine, pyrimidine, pyrazine, piperazine, triazine, indole, indoline, benzoxazole, indazole, benzoimidazole, quinoline, cinnoline, phthalazine, phthalocyanine, quinazoline, quinoxaline, carbazole, acridine, phenanthridine, phenazine, phenoxazine, indolizine, quinolizine, quinuclidine, naphthyladine, purine, pteridine, aziridine, azepine, oxadiazine, dithiazine, benzoquinoline, imidazolethiazole, and the like.

The production of a residual electric potential or production of a so-called memory image, wherein a previous image appears on a subsequent image as either a positive or negative image when multiple copies are made, as a result of the electrical mismatching of the surface protective layer and the Se-As or Se-Te photosensitive member, and the production of a so-called image drift caused by the drift of the electric charge on the mismatched interface are readily induced when halogen atoms, oxygen atoms or nitrogen atoms are not incorporated in the surface protective layer of the present invention, for example, if the aforesaid atoms are not detected by Auger analysis. Furthermore, the adhesive properties of said protective layer and the Se-As or Se-Te photosensitive member are poor and separation of the surface protective layer from the photosensitive member readily occurs when induced by mechanical forces or temperature and moisture fluctuations within the copy machine during times of actual operation. The aforesaid electrical mismatching is thought to be a primary cause of the poor adhesive properties.

The quantity of halogen atoms, oxygen atoms and nitrogen atoms incorporated in the surface protective layer of the present invention can principally be controlled by increasing and decreasing the volume of the gaseous halogen mixture, oxygen mixture or nitrogen mixture input to the reaction chamber wherein the plasma reaction process occurs. When the inflow volume of the aforesaid gases is increased, the quantity of halogen atoms or oxygen atoms or nitrogen atoms added to the a-C layer of the present invention can be increased, and conversely, when the input volume of said compounds is reduced, the quantity of halogen atoms or oxygen atoms or nitrogen atoms added to the a-C layer of the invention can be decreased.

The a-C layer of the present invention contains 0.1 to 50 atomic %, preferably 0.5 to 5 atomic %, of halogen atoms. Also, the quantities of oxygen atoms and nitrogen atoms contained in the a-C layer are 0.1 to 10 atomic %, and preferably 0.5 to 5 atomic %. It is undesirable that the quantity of halogen atoms exceed 50 atomic %, or the quantities of oxygen and nitrogen atoms are greater than 10 atomic %, since under these conditions optimum film formability is not necessarily assured.

When halogen atoms or oxygen atoms or nitrogen atoms are incorporated within an overcoat layer comprised of amorphous carbon as in the present invention, the production of a residual electric potential, or production of a so-called memory image, wherein a previous image appears on a subsequent image during the multiple copy making process, is effectively prevented. Furthermore, because the a-C layer of the present invention has a high degree of hardness and adhesive properties on the Se-As or Se-Te photosensitive member are superior, said a-C layer does not readily separate from the Se-As or Se-Te photosensitive member.

The appropriate film thickness of the a-C layer which forms the Se-As or Se-Te photosensitive member surface protective layer of the present invention is 0.2 to 5 μm. When the film thickness is less than 0.2 μm, the surface hardness is readily affected by the low degree of hardness of the Se-As or Se-Te layer thereunder, and suitable durability cannot be guaranteed. In addition, harmful atoms are deposited on the surface of the photosensitive member by the dispersion of the atoms within the film following the formation of the surface protective layer, and the harmful effect id not necessarily prevented. When the layer thickness exceeds 5 μm, suitable visible light transmittance is not necessarily maintained and the inherent high sensitivity of the Se-As or Se-Te photosensitive member is impaired.

According to the present invention, the gases of starting materials are made into an a-C layer, via a plasma which is produced by a direct current, low- or high-frequency, microwave or like plasma process.

The Se-As or Se-Te photosensitive member of the present invention is formed according to conventional methods such as vacuum deposition or resistance heating processes.

FIG. 1 shows the construction of the photosensitive member of the present invention comprising a conductive substrate 1, an Se-As monolayer or an Se-Te laminated photosensitive layer 2 having Se and Se-Te sequentially-laminated layers formed on the substrate, and a surface protective layer 3, i.e., an a-C layer, formed on the photosensitive layer, each layer being sequentially laminated.

Figure 2:
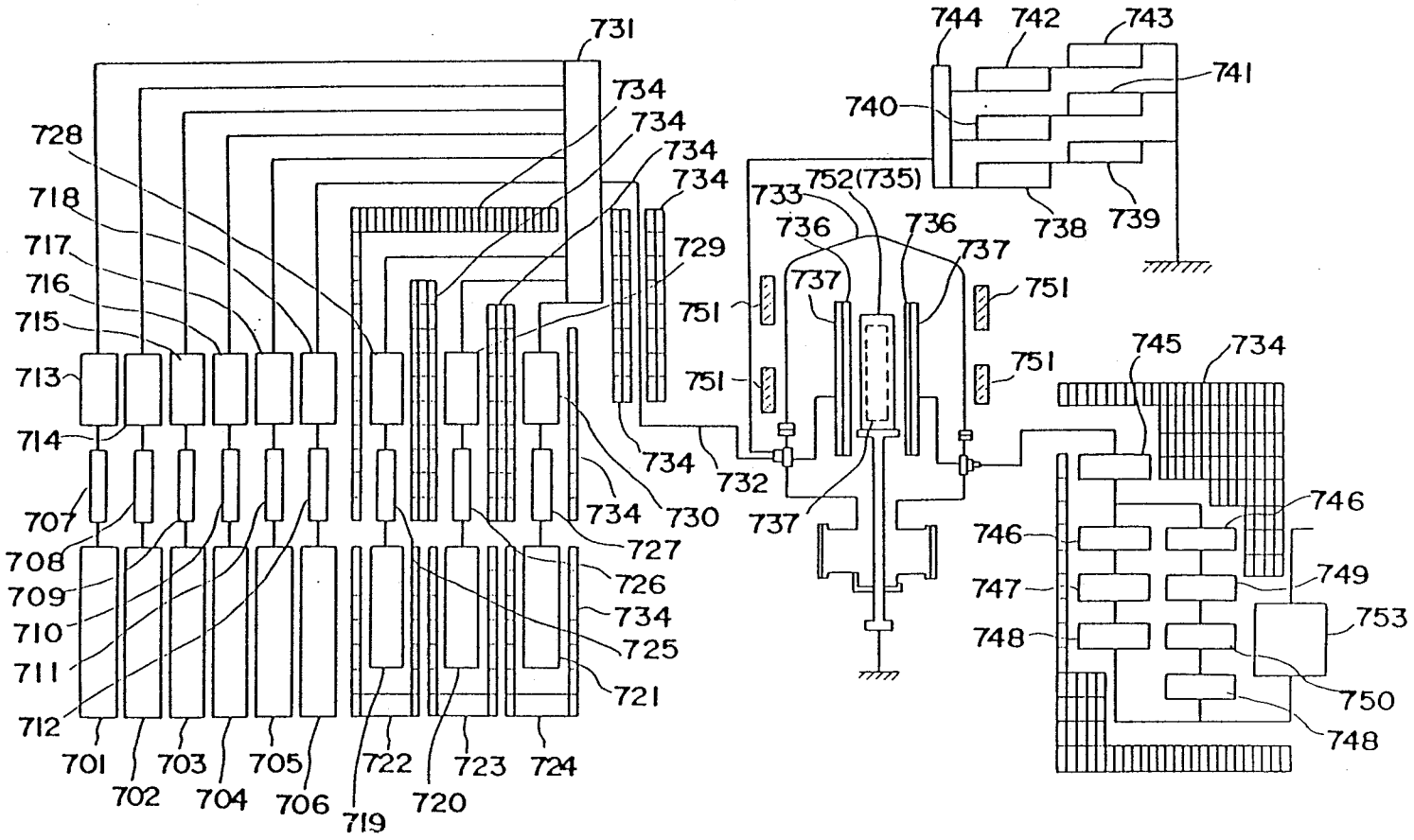
FIGS. 2 and 3 show the manufacturing device used to manufacture the photosensitive member of the present invention.

FIG. 2 shows an apparatus for producing the surface protective layer, i.e., the a-C layer, for the photosensitive member of the present invention. The first to sixth tanks in the drawing have enclosed therein starting material compounds, which are in gas phase at room temperature, and a carrier gas, and are connected respectively to the first to sixth regulator valves 707 to 712 and first to sixth flow controllers 713 to 718. First to third containers 719 to 721 contain starting material compounds which are liquid or solid at room temperature, which can be preheated by first to third heaters 722 to 724 for vaporizing the compounds, and are connected to the seventh to ninth regulator valves 725 to 727 and the seventh to ninth flow controllers 728 to 730, respectively. The gases are mixed in a mixer 731 and fed to a reactor 733 via a main pipe 732. The interconnecting piping can be heated by a pipe heater 734 whch is suitably disposed so that the material compound, in a liquid or solid phase at room temperature and vaporized by preheating, will not condense during transport. A grounded electrode 735 and a power electrode 736 are so arranged that they oppose each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740, and to a direct current power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via the exhaust system selecting valve 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. A substrate 752, which comprises an Se-As or Se-Te photosensitive layer previously formed on an electrically conductive substrate via a vacuum evaporation process, is placed on the electrode in the reactor. Although FIG. 2 shows that the substrate 752 is fixed to the grounded electrode 735, the substrate may be attached to the power application electrode 736 or to both electrodes.

Figure 3:
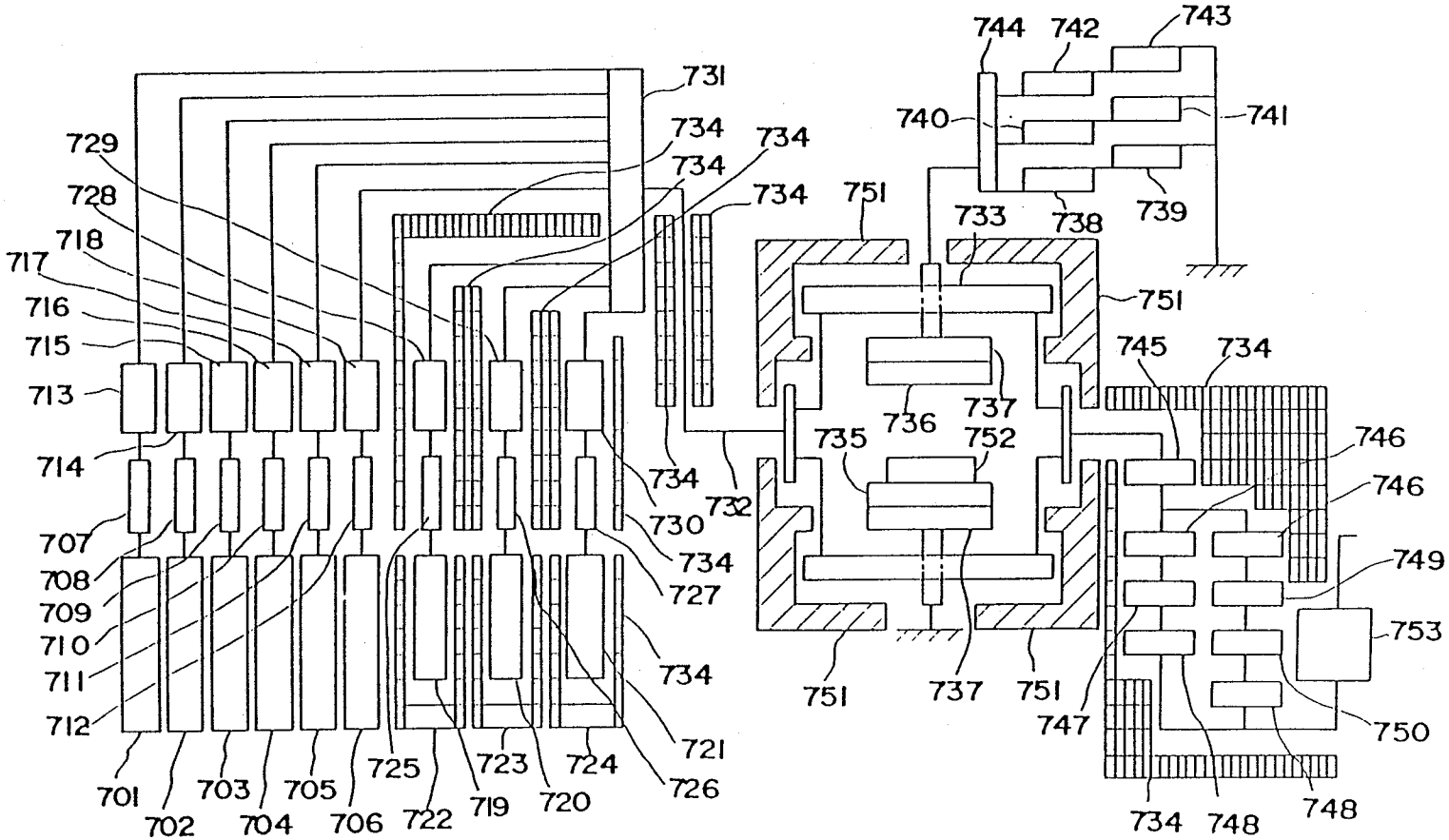

FIG. 3 shows another type of apparatus for producing the surface protective layer, i.e., the a-C layer, of the photosensitive member of the invention. This apparatus has the same construction as the apparatus of FIG. 2 with the exception of the interior arrangement of the reactor 733. With reference to FIG. 3, the reactor 733 is internally provided with a hollow cylindrical substrate 752, comprising a selenium photoconductive layer previously formed on an electrically conductive substrate via a separate vacuum evaporation process, serving also as the grounded electrode 735 of FIG. 2, and with an electrode heater 737 inside thereof. A power application electrode 736, similarly in the form of a hollow cylinder, is provided around the substrate 752 and surrounded by an electrode heater 737. The conductive substrate 752, which comprises an Se-As or Se-Te photosensitive layer, is rotatable about its own axis by a drive motor 754 from outside.

The reactor for preparing the photosensitive member is first evacuated by the diffusion pump to a vacuum of about $10^{-4}$ to about $10^{-6}$ torr, whereby the adsorbed gas within the reactor is removed. The reactor is also checked for the degree of vacuum. At the same time, the electrodes and the substrate fixedly placed on the electrode are heated to a predetermined temperature by the electrode heater. In order to prevent heat conversion of the Se-As and Se-Te photosensitive layer at this time, it is desirable that the substrate temperature of the photosensitive member having a selenium layer be approximately 90° C. or less, while that of the photosensitive member comprising a selenium-arsenic alloy only be about 250° C. or less. It is also desirable that the raised temperature be maintained not more than 30 min with the time required for raising and lowering the temperature being not more than 1 hr. Subsequently, material gases, i.e., suitably selected hydrocarbons and halogen, oxygen, or nitrogen compounds, are fed into the reactor at a specified flow rate using the first to ninth flow controllers, and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. This initiates a discharge across the two electrodes, forming a solid film on the substrate with time. The thickness of the layer is controllable by varying the reaction time, such that the discharge is discontinued upon the thickness reaching the desired value. Consequently, an a-C layer according to the invention is obtained which serves as a surface protective layer. The a-C layer is a noncrystalline hydrocarbon layer of the present invention which contains halogen atoms or oxygen atoms or nitrogen atoms. A photosensitive member of the present invention having a surface protective layer is obtained via the aforesaid process.

The present invention will be hereinafter described with reference to the following examples.

EXAMPLES 1 AND 2

Surface protective layers of the present invention for a photosensitive member were produced using a glow discharge decomposition device as shown in FIG. 2.

First the interior of the reactor 733 was evacuated to a high vacuum of approximately $10^{-5}$ to $10^{-6}$ torr, and the first, second and third regulator valves 707, 708 and 709 were thereafter opened to introduce hydrogen gas from the first tank 701, acetylene gas from the second tank 702, and tetrafluoromethane gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 40 sccm, the acetylene gas at 40 sccm, and the tetrafluoromethane gas at 40 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, a substrate 752 was used, said substrate being an aluminum substrate measuring 50 mm in length, 50 mm in width and 3 mm in thickness and having an Se-As photosensitive layer (Example 1) or an Se-Te photosensitive layer (Example 2) previously formed thereon to a film thickness of approximately 50 μm in accordance with conventional methods and using a separate vacuum evaporation device. The temperature of substrate 752 was raised from room temperature to 80° C. over about a 15 min period prior to the introduction of the gases. With the gas flow rates and the pressure in stabilized states, 200-watt power with a frequency of 13.56 MHz was applied to the power application electrode 736 from the high-frequency power source 739 pre-connected thereto by the selecting switch 744 to conduct plasma polymerization for approximately 10 min, forming an a-C layer, i.e., a surface protective layer, 0.6 μm in thickness on the substrate 752. After completion of the film formation, the power supply was discontinued, the regulator valves were closed with the exception of the hydrogen gas valve, hydrogen gas alone was fed into the reactor 733 at 200 sccm, a pressure of 10 torr was maintained, and the temperature was reduced to 50° C. over a 15 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 45 atomic % of hydrogen atoms based on the combined amount of hydrogen and carbon atoms, and under Auger analysis the layers were found to contain 2.5 atomic % of halogen atoms, i.e., fluorine atoms based on the atoms of the entire structure. Characteristics:

The surfaces of the photosensitive members obtained in Example 1 and Example 2 had hardnesses of approximately 6H based on measurements for pencil lead hardness as provided in Japanese Industrial Standards JIS K-5400, and it is understood that the high degree of hardness was achieved via the surface protective layer of the photosensitive member of the present invention.

Furthermore, when the photosensitive member obtained in Example 1 was measured for white light sensitivity using the normal Carlson process, the amount of light required for light decay was 0.99 lux-sec, and since the measured value prior to the manufacture of the surface protective layer was about 0.93 lux-sec, it is understood that the photosensitive member surface protective layer of the present invention does not impair the inherent sensitivity of the Se-As photosensitive member. Also, the photosensitive member obtained in Example 2 was measured for photosensitivity at 780 nm using the normal Carlson process, the amount of light required for light decay being about 5.2 erg/cm$^2$, and since the measured value prior to the manufacture of the surface protective layer was about 5.0 erg/cm$^2$, it is understood that the surface protective layer of the photosensitive member of the present invention does not impair the inherent sensitivity of the Se-Te photosensitive member.

In addition, the photosensitive members obtained in Examples 1 and 2 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As and Se-Te photosensitive members.

EXAMPLES 3 AND 4

Surface protective layers of the present invention for a photosensitive member were produced using a glow discharge decomposition device as shown in FIG. 3.

First the interior of the reactor 733 was evacuated to a high vacuum of approximately $10^{-5}$ to $10^{-6}$ torr, and the first, second and third regulator valves 707, 708 and 709 were thereafter opened to introduce hydrogen gas from the first tank 701, acetylene gas from the second tank 702, and tetrafluoromethane gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 250 sccm, the acetylene gas at 200 sccm, and the tetrafluoromethane gas at 200 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate measuring 80 mm in diameter and 329 mm in length and having an Se-As photosensitive layer (Example 3) or an Se-Te photosensitive layer (Example 4) previously formed thereon to a film thickness of approximately 50 μm in accordance with conventional methods and using a separate vacuum evaporation device. The temperature of substrate 752 was raised from room temperature to 80° C. over about a 20 min period prior to the introduction of the gases. With the gas flow rates and the pressure in stabilized states, 250-watt power with a frequency of 13.56 MHz was applied to the power application electrode 736 from the high-frequency power source 739 preconnected thereto by the selecting switch 744 to conduct plasma polymerization for approximately 15 min, forming an a-C layer, i.e., a surface protective layer, 0.8 μm in thickness on the substrate 752. After completion of the film formation, the power supply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over a 20 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 44 atomic % of hydrogen atoms based on the combined amount of hydrogen and carbon atoms, and under Auger analysis the layers were found to contain 2.7 atomic % of halogen atoms, i.e., fluorine atoms based on the atoms of the entire structure.

Characteristics

The surfaces of the photosensitive members obtained in Example 3 and Example 4 had hardnesses of 7H and greater based on measurements for pencil lead hardness as provided in Japanese Industrial Standards JIS K 5400, and it is understood that the high degree of hardness was achieved via the surface protective layer of the photosensitive member of the present invention.

Furthermore, when the photosensitive member obtained in Example 3 was measured for white light sensitivity using the normal Carlson process, the amount of light required for light decay was 0.95 lux-sec, and since the measured value prior to the manufacture of the surface protective layer was about 0.90 lux-sec, it is understood that the surface protective layer of the photosensitive member of the present invention does not impair the inherent sensitivity of the Se-As photosensitive member. Also, the photosensitive member obtained in Example 4 was measured for photosensitivity at 780 nm using the normal Carlson process, the amount of light required for light decay being about 5.3 erg/cm$^2$, and since the measured value prior to the manufacture of the surface protective layer was about 5.2 erg/cm$^2$, it is understood that the photosensitive member surface protective layer of the present invention does not impair the inherent sensitivity of the Se-Te photosensitive member.

In addition, the photosensitive members obtained in Examples 3 and 4 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As and Se-Te phctosensitive members.

When the photosensitive member obtained in Example 3 was installed in a Minolta Model EP650Z copy machine and copies made, clear images were obtained without a single instance of so-called memory image, and so-called image drift was not observed when copies were made under environmental conditions of 35° C. temperature and 80% humidity. Neither was any separation of the surface protective layer noted when said layer came into contact with the developer, copy paper, and cleaning components within the copy machine. Under normal room conditions, 250,000 copies were made and clear images were obtained to the last. Additionally, the surface was subjected to component analysis after making the 250,000 copies using Auger analysis and neither selenium nor arsenic were detected. From these results it can be understood that the photosensitive member surface prctective layer of the present invention improved the harmful aspects and increased durability while it did not impair image quality.

When the photosensitive member obtained in Example 4 was installed in a Minolta Model EP450Z copy machine and copies made using an optical system modified to a conventional semiconductor laser exposure system comprising a semiconductor laser, polygon mirror scanner, drive system, and the like, clear images were obtained without a single instance of so-called memory image, and so-called image drift was not observed when copies were made under environmental conditions of 35° C. temperature and 80% humidity.

Neither was any separation of the surface protective layer noted when said layer came into contact with the developer, copy paper, and cleaning components within the copy machine. Under normal room conditions, 200,000 copies were made and clear images were obtained to the last. Additionally, the surface was subjected to component analysis after making the 200,000 copies using Auger analysis, and neither selenium, tellurium, or the like were detected. From these results it can be understood that the photosensitive member surface protective layer of the present invention improved the harmful aspects and increased of the underlying alloy, while it did not impair image quality.

EXAMPLE 5

A surface protective layer of the present invention for a photosensitive member was produced using a glow discharge decomposition device as shown in FIG. 3.

First the interior of the reactor 733 was evacuated to a high vacuum of approximately $10^{-5}$ to $10^{-6}$ torr, and the first and third regulator valves (707 and 709) were thereafter opened to introduce argon gas from the first tank 701, and butadiene gas from the third tank 703 into the first and third flow controllers 713 and 715, respectively, each at an output pressure of 1.0 kg/cm$^2$. At the same time, the seventh controller valve 725 was opened, chloroform gas from the first container 719 was fed to the seventh flow controller 728 at a temperature of 15° C. heated by the first heater 722. The dials on the flow controllers were adjusted to supply the argon gas at a flow rate of 200 sccm, the butadiene gas at 150 sccm, and the chloroform gas at 150 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 20° C. over about a 30 min period prior to the introduction of the gases. With the gas flow rates and the pressure in stabilized states, 120-watt power with a frequency of 30 KHz was applied to the power application electrode 736 from the low-frequency power source 741 pre-connected thereto by the selecting switch 744 to conduct plasma polymerization for approximately 10 min, forming an a-C layer, i.e., a surface protective layer, 1.5 μm in thickness on the substrate 752. After completion of the film formation, the power supply was discontinued, the regulator valves were closed with the exception of the argon gas valve, argon gas alone was fed into the reactor 733 at 600 sccm, a pressure of 10 torr was maintained, and the temperature was reduced to 50° C. over about a 30 min period. Thereafter, the argon gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 50 atomic % of hydrogen atoms based on the combined amount of hydrogen and carbon atoms, and under Auger analysis the layer was found to contain 25 atomic % of halogen atoms, i.e., chlorine atoms based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the surface protective layer of the photosensitive member of the present invention.

Furthermore, when measured for white light sensitivity using the normal Carlson process, the amount of light required for light decay was 1.0 lux-sec, and since the measured value prior to the manufacture of the surface protective layer was about 0.89 lux-sec, it is understood that the surface protective layer of the photosensitive member of the present invention does not impair the inherent sensitivity of the Se-As photosensitive member.

In addition, the photosensitive member was exposed to atmospheric conitions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 3, superior image, adhesive properties, ambience resistance, durability and nonpolluting characteristics were confirmed.

EXAMPLE 6

A surface protective layer of the present invention for a photosensitive member was produced using a glow discharge decomposition device as shown in FIG. 3.

First the interior of the reactor 733 was evacuated to a high vacuum of approximately $10^{-5}$ to $10^{-6}$ torr, and the first and third regulator valves (707 and 709) were thereafter opened to introduce hydrogen gas from the first tank 701 and tetrafluoromethane gas from the third tank 703 into the first and third flow controllers 713 and 715, respectively, each at an output pressure of 1.0 kg/cm$^2$. At the same time, the seventh controller valve 725 was opened, and myrcene gas from the first container 719 was fed to the seventh flow controller 728 at a temperature of 85° C. as heated by the first heater 722. The dials on the flow controllers were adjusted to supply the hydrogen gas at a flow rate of 50 sccm, the tetrafluoromthane to gas at 15 sccm, and the myrcene gas at 100 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 200° C. over about a 30 min period prior to the introduction of the gases. With the gas flow rates and the pressure in stabilized states, 120-watt power with a frequency of 45 KHz was applied to the power application electrode 736 from the low-frequency power source 741 pre-connected thereto by the selecting switch 744 to conduct plasma polymerization for approximately 10 min, forming an a-C layer, i.e., a surface protective layer, 4.5 μm in thickness on the substrate 752. After completion of the film formation, the power suply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over about a 30 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 35 atomic % of hydrogen atoms based on the combined amount of hydrogen and carbon atoms, and under Auger analysis the layer was found to contain 0.2 atomic % of halogen atoms, i.e., fluorine atoms based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the surface protective layer of the photosensitive member of the present invention.

Furthermore, when measured for white light sensitivity using the normal Carlson process, the amount of light required for light decay was 1.05 lux-sec, and since the measured value prior to the manufacture of the surface protective layer was about 0.87 lux-sec, it is understood that the surface protective layer of the photosensitive member of the present invention does not impair the inherent sensitivity of the Se-As photosensitive member In addition, the photosensitive member was exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 3, superior image, adhesive properties, ambience resistance, durability and nonpolluting characteristics were confirmed.

COMPARATIVE EXAMPLES 1AND 2

Overcoat layers were formed on an Se-As photosensitive member (Comparative Example 1) and an Se-Te photosensitive member (Comparative Example 2) as per Examples 3 and 4 except the inflow of tetrafluoromethane gas was omitted.

When Auger analysis was performed on these overcoat layers, halogen atoms, i.e., fluorine atoms, were not detected, for example, although extremely minute quantities of oxygen atoms contaminated the layers, said quantities are understood to be below the detection limits of Auger analysis of 0.1 atomic %.

Many characteristics showed values resembling those of Examples 3 and 4, but when these photosensitive members were installed in copy machines and continuous copy operations performed, so-called memory images were produced wherein a previous image appears as a negative on a subsequent image, and suitable images were not obtained under these actual field conditions. From these results it is understood that electrical conformity was improved by the addition of halogen atoms with the result that image quality was also improved.

After completion of the field tests, the photosensitive members obtained in Comparative Examples 1 and 2 were exposed to atmospheric conditions of low temperature-low humidity (10° C. and 30% humidity) and high temperature-high humidity (50° C. and 90% humidity) which were alternated every 30 min each over a six hour period, with the result that the surface protective layers gradually separated from the edges of the drum-shaped photosensitive members and eventually separated from the entire drum surface along with the appearance of cracks in said layer surface, and from which results it is understood that the photosensitive member surface protective layer of the present invention had improved adhesion properties vis-a-vis the Se-As and Se-Te photosensitive members via the addition of halogen.

EXAMPLES 7 AND 8

A surface protective layers of the present invention for a photosensitive member were produced using a glow discharge decomposition device as shown in FIG. 2.

First the interior of the reactor 733 was evacuated to a high vacuum of approximately $10^{-6}$ torr, and the first, second and third regulator valves (707, 708 and 709) were thereafter opened to introduce hydrogen gas from the first tank 701, acetylene gas from the second tank 702, and carbon dioxide gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 40 sccm, the acetylene gas at 40 sccm, and the carbon dioxide gas at 40 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate measuring 50 mm in length, 50 mm in width and 3 mm in thickness and having an Se-As photosensitive layer (Example 7) or an Se-Te photosensitive layer (Example 8) previously formed thereon to a film thickness of approximately 50 μm in accordance with conventional methods and using a separate vacuum evaporation device. The temperature of substrate 752 was raised from room temperature to 80° C. over about a 15 min period prior to the introduction of the gases. With the gas flow rates and the pressure in stabilized states, 200-watt power with a frequency of 13.56 MHz was applied to the power application electrode 736 from the high-frequency power source 739 preconnected thereto by the selecting switch 744 to conduct plasma polymerization for approximately 10 min, forming an a-C layer, i.e., a surface protective layer, 0.6 μm in thickness on the substrate 752. After completion of the film formation, the power supply was discontinued, the regulator valves were closed with the exception of the hydrogen gas valve, hydrogen gas alone was fed into the reactor 733 at 200 sccm, a pressure of 10 torr was maintained, and the temperature was reduced to 50° C. over a 15 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 45 atomic % of hydrogen atoms based on the combined amount of hydrogen and carbon atoms, and under Auger analysis the layers were found to contain 1.7 atomic % of oxygen atoms, based on the atoms of the entire structure.

Characteristics

The surfaces of the photosensitive members obtained in Example 7 and Example 8 had hardnesses of approximately 6H based on measurements for pencil lead hardness as provided in Japanese Industrial Standards JIS K-5400, and it is understood that the high degree of hardness was achieved via the photosensitive member surface protective layer the present invention.

Furthermore, when the photosensitive member obtained in Example 7 was measured for white light sensitivity using the normal Carlson process, the amount of light required for light decay was 0.89 lux-sec, and since the measured value prior to the manufacture of the surface protective layer was about 0.85 lux-sec, it is understood that the surface protective layer of the photosensitive member of the present invention does not impair the inherent sensitivity of the Se-As photosensitive member. Also, the photosensitive member obtained in Example 8 was measured for photosensitivity at 780 nm using the normal Carlson process, the amount of light required for light decay being about 5.5 erg/cm$^2$, and since the measured value prior to the manufacture of the surface protective layer was about 5.1 erg/cm$^2$, it is understood that the surface protective layer of the photo-sensitive member of the present invention does not impair the inherent sensitivity of the Se-Te photosensitive member.

In addition, the photosensitive members obtained in Examples 7 and 8 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As and Se-Te photosensitive members.

EXAMPLES 9AND 10

Surface protective layers of the present invention for a photosensitive member were produced using a glow discharge decomposition device as shown in FIG. 3.

First the interior of the reactor 733 was evacuated to a high vacuum of approximately $10^{-6}$ torr, and the first, second and third regulator valves (707, 708 and 709) were thereafter opened to introduce hydrogen gas from the first tank 701, acetylene gas from the second tank 702, and carbon dioxide gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 250 sccm, the acetylene gas at 200 sccm, and the carbon dioxide gas at 200 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate measuring 80 mm in diameter and 329 mm in length and having an Se-As photosensitive layer (Example 9) and an Se-Te photosensitive layer (Example 10) previously formed thereon to a film thickness of approximately 50 μm in accordance with conventional methods and using a separate vacuum evaporation device. The temperature of substrate 752 was raised from room temperature to 80° C. over about a 20 min period prior to the introduction of the gases. With the gas flow rates and the pressure in stabilized states, 250-watt power with a frequency of 13.56 MHz was applied to the power application electrode 736 from the high-frequency power source 739 preconnected thereto by the selecting switch 744 to conduct plasma polymerization for approximately 15 min, forming an a-C layer, i.e., a surface protective layer, 0.8 μm in thickness on the substrate 752. After completion of the film formation, the power supply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over a 20 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 44 atomic % of hydrogen atoms based on the combined amount of hydrogen and carbon atoms, and under Auger analysis the layers were found to contain 2.0 atomic % of oxygen atoms, based on the atoms of the entire structure.

Characteristics

The surfaces of the photosensitive members obtained in Example 9 and Example 10 had hardnesses of 7H and greater based on measurements for pencil lead hardness as provided in Japanese Industrial Standards JIS K-5400, and it is understood that the high degree of hardness was achieved via the surface protective layer of the photosensitive member of the present invention.

Furthermore, when the photosensitive member obtained in Example 9 was measured for white light sensitivity using the normal Carlson process, the amount of light required for light decay was 0.93 lux-sec, and since the measured value prior to the manufacture of the surface protective layer was about 0.88 lux-sec, it is understood that the photosensitive member surface protective layer of the present invention does not impair the inherent sensitivity of the Se-As photosensitive member. Also, the photosensitive member obtained in Example 10 was measured for photosensitivity at 780 nm using the normal Carlson process, the amount of light required for light decay being about 5.6 erg/cm$^2$, and since the measured value prior to the manufacture of the surface protective layer was about 5.2 erg/cm$^2$, it is understood that the surface protective layer of the photo-sensitive member of the present invention does not impair the inherent sensitivity of the Se-Te photosensitive member.

In addition, the photosensitive members obtained in Examples 9 and 10 were exposed to atmospheric conditions of low temperature-low humidity (10° C. and 30% humidity) and high temperature-high humidity (50° C. and 90% humidity) which were alternated every 30 min each over a six hour period; cracking or separation of the surface protective layer was not observed, from which results it is understood that the photosensitive member surface protective layer of the present invention has superior adhesive properties regarding its adhesion to the Se-As and Se-Te photosensitive members.

When the photosensitive member obtained in Example 9 was installed in a Minolta Model EP650Z copy machine and copies made, clear images were obtained without a single instance of so-called memory image, and so-called image drift was not observed when copies were made under environmental conditions of 35° C. temperature and 80% humidity. Neither was any separation of the surface protective layer noted when said layer came into contact with the developer, copy paper, and cleaning components within the copy machine. Under normal room conditions, 250,000 copies were made and clear images were obtained to the last. Additionally, the surface was subjected to component analysis after making the 250,000 copies using Auger analysis, and neither selenium nor arsenic were detected. From these results it can be understood that the photosensitive member surface protective layer of the present invention improved the harmful aspects and increased durability of the underlying layer, while it did not impair image quality.

When the photosensitive member obtained in Example 10 was installed in a Minolta Model EP450Z copy machine and copies made using an optical system modified to a conventional semiconductor laser exposure system comprising a semiconductor laser, polygon mirror scanner, drive system, and the like, clear images were obtained without a single instance of so-called memory image, and so-called image drift was not observed when copies were made under environmental conditions of 35° C. temperature and 80% humidity. Neither was any separation of the surface protective layer noted when said layer came into contact with the developer, copy paper, and cleaning components within the copy machine. Under normal room conditions, 200,000 copies were made and clear images were obtained to the last. Additionally, the surface was subjected to component analysis after making the 200,000 copies using Auger analysis, and neither selenium, tellurium, or the like were detected. From these results it can be understood that the photosensitive member surface protective layer of the present invention improved the harmful aspects and increased durability of the underlying layer, while it did not impair image quality.

EXAMPLES 11 AND 12

Surface protective layers of the present invention for photosensitive members were produced using a glow discharge decomposition device is shown in FIG. 3.

First the interior of the reactor 733 was evacuated to a high vacuum of approximately $10^{-6}$ torr, and the first and third regulator valves (707 and 709) were thereafter opened to introduce argon gas from the first tank 701, and ethylene gas from the third tank 703 into the first and third flow controllers 713 and 715, respectively, each at an output pressure of 1.0 kg/cm$^2$. At the same time, the seventh and eighth controller valves 725 and 726 were opened, and styrene gas from the first container 719, with the first heater 722 temperature under 60° C., and cyclohexanone from the second container 720, with the second heater 723 temperature under 80° C., were fed to the seventh and eighth flow controllers 728 and 729, respectively. The dials on the flow controllers were adjusted to supply the argon gas at a flow rate of 200 sccm, the ethylene gas at 150 sccm, the styrene gas at 100 sccm, and the cyclohexanone gas at 50 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer (Example 11) or an Se-Te photosensitive layer (Example 12) previously formed thereon to a film thickness of approximately 50 μm in accordance with conventional methods and using a separate vacuum evaporation device. The temperature of substrate 752 was raised from room temperature to 80° C. over about a 20 min period prior to the introduction of the gases. With the gas flow rates and the pressure in stabilized states, 100-watt power with a frequency of 30 KHz was applied to the power application electrode 736 from the low-frequency power source 741 pre-connected thereto by the selecting switch 744 to conduct plasma polymerization for approximately 10 min, forming an a-C layer, i.e., a surface protective layer, 3.6 μm in thickness on the substrate 752. After completion of the film formation, the power supply was discontinued, the regulator valves were closed with the exception of the argon gas valve, argon gas alone was fed into the reactor 733 at 600 sccm, a pressure of 10 torr was maintained, and the temperature was reduced to 50° C. over about a 15 min period. Thereafter, the argon gas regulator valve was closed, the reactor 733 was fully exhausted, and the substrate temperature was further reduced to 30° C., whereupon the vacuum was broken in reactor 733, and the photosensitive members having the surface protective layers of the present invention were removed.

When subjected to CHN quantitative analysis, the a-C layers thus obtained were found to contain 37 atomic % of hydrogen atoms based on the combined amount of hydrogen and carbon atoms, and under Auger analysis the layer was found to contain 7 atomic % of oxygen atoms, based on the atoms of the entire structure.

Characteristics

The surfaces of the obtained photosensitive members in both Examples 11 and 12 had hardnesses of approximately 7H based on measurements for pencil lead hardness as provided in Japanese Industrial Standards JIS K-5400, and it is understood that the high degree of hardness was achieved via the photosensitive member surface protective layer of the present invention.

Furthermore, when the photosensitive member of Example 11 was measured for white light sensitivity using the normal Carlson process, the amount of light required for light decay was 1.2 lux-sec, and since the measured value prior to the manufacture of the surface protective layer was about 0.96 lux-sec, it is understood that the photosensitive member surface protective layer of the present invention does not impair the inherent sensitivity of the Se-As photosensitive member. Also, the photosensitive member obtained in Example 10 was measured for photosensitivity at 780 nm using the normal Carlson process, the amount of light required for light decay were about 5.6 erg/cm$^2$, and since the measured value prior to the manufacture of the surface protective layer was about 5.3 erg/cm$^2$, it is understood that the photosensitive member surface protective layer of the present invention does not impair the inherent sensitivity of the Se-Te photosensitive member.

In addition, the photosensitive members of Examples 11 and 12 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive members of Examples 11 and 12 were installed in a copy machine and copies made as per Examples 9 and 10, superior image, adhesive properties, ambience resistance, durability and nonpolluting characteristics were confirmed.

EXAMPLE 13

A surface protective layer of the present invention for a photosensitive member was produced using a glow discharge decomposition device as shown in FIG. 3.

First the interior of the reactor 733 was evacuated to a high vacuum of approximately $10^{-6}$ torr, and the first and third regulator valves (707 and 709) were thereafter opened to introduce argon gas from the first tank 701, and butadiene gas from the third tank 703 into the first and third flow controllers 713 and 715, respectively, each at an output pressure of 1.0 kg/cm$^2$. At the same time, the seventh controller valve 725 was opened, acetone gas from the first container 719 was fed to the seventh flow controller 728 at a temperature of 5° C. as heated by the first heater 722. The dials on the flow controllers were adjusted to supply the argon gas at a flow rate of 200 sccm, the butadiene gas at 150 sccm, and the acetone gas at 150 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 200° C. over about a 30 min period prior to the introduction of the gases. With the gas flow rates and the pressure in stabilized states, 150-watt power with a frequency of 30 KHz was applied to the power application electrode 736 from the low-frequency power source 741 pre-connected thereto by the selecting switch 744 to conduct plasma polymerization for approximately 10 min, forming an a-C layer, i.e., a surface protective layer, 2.2 μm in thickness on the substrate 752. After completion of the film formation, the power supply was discontinued, the regulator valves were closed with the exception of the argon gas valve, argon gas alone was fed into the reactor 733 at 600 sccm, a pressure of 10 torr was maintained, and the temperature was reduced to 50° C. over about a 30 min period. Thereafter, the argon gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 49 atomic % of hydrogen atoms based on the combined amount of hydrogen and carbon atoms, and under Auger analysis the layer was found to contain 11 atomic % of oxygen atoms, based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the photosensitive member surface protective layer of the present invention.

Furthermore, when measured for white light sensitivity using the normal Carlson process, the amount of light required for light decay was 1.0 lux-sec, and since the measured value prior to the manufacture of the surface protective layer was about 0.92 lux-sec, it is understood that the photosensitive member surface protective layer of the present invention does not impair the inherent sensitivity of the Se-As photosensitive member.

In addition, the photosensitive member was exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 9, superior image, adhesive properties, ambience resistance, durability and nonpolluting characteristics were confirmed.

EXAMPLE 14

A surface protective layer of the present invention for a photosensitive member was produced using a glow discharge decomposition device as shown in FIG. 3.

First the interior of the reactor 733 was evacuated to a high vacuum of approximately $10^{-6}$ torr, and the first and third regulator valves (707 and 709) were thereafter opened to introduce hydrogen gas from the first tank 701 and carbon dioxide gas from the third tank 703 into the first and third flow controllers 713 and 715, respectively, each at an output pressure of 1.0 kg/cm$^2$. At the same time, the seventh controller valve 725 was opened, and myrcene gas from the first container 719 was fed to the seventh flow controller 728 at a temperature of 85° C. as heated by the first heater 722. The dials on the flow controllers were adjusted to supply the hydrogen gas at a flow rate of 50 sccm, the carbon dioxide gas at 10 sccm, and the myrcene gas at 100 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 20° C. over about a 30 min period prior to the introduction of the gases. With the gas flow rates and the pressure in stabilized states, 120-watt power with a frequency of 45 KHz was applied to the power application electrode 736 from the low-frequency power source 741 pre-connected thereto by the selecting switch 744 to conduct plasma polymerization for approximately 10 min, forming an a-C layer, i.e., a surface protective layer, 4.3 μm in thickness on the substrate 752. After completion of the film formation, the power supply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over about a 30 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 35 atomic % of hydrogen atoms based on the combined amount of hydrogen and carbon atoms, and under Auger analysis the layer was found to contain 0.2 atomic % of oxygen atoms based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the surface protective layer of the photosensitive member of the present invention.

Furthermore, when measured for white light sensitivity using the normal Carlson process, the amount of light required for light decay was 0.91 lux-sec, and since the measured value prior to the manufacture of the surface protective layer was about 0.87 lux-sec, it is understood that the surface protective layer of the photosensitive member of the present invention does not impair the inherent sensitivity of the Se-As photosensitive member.

In addition, the photosensitive member was exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 9, superior image, adhesive properties, ambience resistance, durability and nonpolluting characteristics were confirmed.

COMPARATIVE EXAMPLES 3 AND 4

Overcoat layers were formed on an Se-As photosensitive member (Comparative Example 3) and an Se-Te photosensitive member (Comparative Example 4) as per Examples 9 and 10 except the inflow of carbon dioxide gas was omitted.

When Auger analysis was performed on these overcoat layers, oxygen atoms were not detected, for example, although extremely minute quantities of oxygen atoms contaminated the layers, said quantities are understood to be below the detection limits of Auger analysis of 0.1 atomic %.

Many characteristics showed values resembling those of Examples 9 and 10, but when these photosensitive members were installed in copy machines and continuous copy operations performed, so-called memory images were produced wherein a previous image appears as a negative on a subsequent image, and suitable images were not obtained under these actual field conditions. From these results it is understood that electrical conformity was improved by the addition of oxygen atoms with the result that image quality was also improved.

After completion of the field tests, the photosensitive members obtained in Comparative Examples 3 and 4 were exposed to atmospheric conditions of low temperature-low humidity (10° C. and 30% humidity) and high temperature-high humidity (50° C. and 90% humidity) which were alternated every 30 min each over a six hour period, with the result that the surface protective layers gradually separated from the edges of the drum-shaped photosensitive members and eventually separated from the entire drum surface along with the appearance of cracks in said layer surface, and from which results it is understood that the photosensitive member surface protective layer of the present invention had improved adhesion properties vis-a-vis the Se-As and Se-Te photosensitive members via the addition of oxygen.

COMPARATIVE EXAMPLES 5 AND 6

Overcoat layers were formed on an Se-As photosensitive member (Comparative Example 5) and an Se-Te photosensitive member (Comparative Example 6) as per Examples 11 and 12 except the inflow of cyclohexanone gas was omitted.

When Auger analysis was performed on these overcoat layers, oxygen atoms were not detected, for example, although extremely minute quantities of oxygen atoms contaminated the layers, said quantities are understood to be below the detection limits of Auger analysis of 0.1 atomic %.

Many characteristics showed values resembling those of Examples 11 and 12, but when these photosensitive members were installed in copy machines and continuous copy operations performed, so-called memory images were produced wherein a previous image appears as a negative on a subsequent image, and suitable images were not obtained under these actual field conditions. From these results it is understood that electrical conformity was improved by the addition of oxygen atoms with the result that image quality was also improved.

After completion of the field tests, the photosensitive members obtained in Comparative Examples 5 and 6 were exposed to atmospheric conditions of low temperature-low humidity (10° C. and 30% humidity) and high temperature-high humidity (50° C. and 90% humidity) which were alternated every 30 min each over a six hour period, with the result that the surface protective layers separated from the entire surface of the respective photosensitive members, and from which results it is understood that the photosensitive member surface protective layer of the present invention had improved adhesion properties vis-a-vis the Se-As and Se-Te photosensitive members via the addition of oxygen.

EXAMPLES 15 AND 16

Surface protective layers of the present invention for a photosensitive member was produced using a glow discharge decomposition device as shown in FIG. 2.

First the interior of the reactor 733 was evacuated to a high vacuum of approximately $10^{-6}$ torr, and the first, second and third regulator valves 707, 708 and 709 were thereafter opened to introduce hydrogen gas from the first tank 701, acetylene gas from the second tank 702, and nitrogen gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 40 sccm, the acetylene gas at 40 sccm, and the nitrogen gas at 40 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate measuring 50 mm in length, 50 mm in width and 3 mm in thickness and having an Se-As photosensitive layer (Example 15) or an Se-Te photosensitive layer (Example 16) previously formed thereon to a film thickness of approximately 50 μm in accordance with conventional methods and using a separate vacuum evaporation device. The temperature of substrate 752 was raised from room temperature to 80° C. over about a 15 min period prior to the introduction of the gases. With the gas flow rates and the pressure in stabilized states, 200-watt power with a frequency of 13.56 MHz was applied to the power application electrode 736 from the high-frequency power source 739 pre-connected thereto by the selecting switch 744 to conduct plasma polymerization for approximately 10 min, forming an a-C layer, i.e., a surface protective layer, 0.5 μm in thickness on the substrate 752. After completion of the film formation, the power supply was discontinued, the regulator valves were closed with the exception of the hydrogen gas valve, hydrogen gas alone was fed into the reactor 733 at 200 sccm, a pressure of 10 torr was maintained, and the temperature was reduced to 50° C. over a 15 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 45 atomic % of hydrogen atoms based on the combined amount of hydrogen and carbon atoms, and under Auger analysis the layers were found to contain 1.2 atomic % of nitrogen atoms based on the atoms of the entire structure.

Characteristics

The surfaces of the photosensitive members obtained in Example 15 and Example 16 had hardnesses of approximately 7H based on measurements for pencil lead hardness as provided in Japanese Industrial Standards JIS K-5400, and it is understood that the high degree of hardness was achieved via the surface protective layer of the photosensitive member of the present invention.

Furthermore, when the photosensitive member obtained in Example 15 was measured for white light sensitivity using the normal Carlson process, the amount of light required for light decay was 0.92 lux-sec, and since the measured value prior to the manufacture of the surface protective layer was about 0.88 lux-sec, it is understood that the photosensitive member surface protective layer of the present invention does not impair the inherent sensitivity of the Se-As photosensitive member. Also, the photosensitive member obtained in Example 16 was measured for photosensitivity at 780 nm using the normal Carlson process, the amount of light required for light decay being about 5.7 erg/cm$^2$, and since the measured value prior to the manufacture of the surface protective layer was about 5.7 erg/cm$^2$, it is understood that the surface protective layer of the photo-sensitive member of the present invention does not impair the inherent sensitivity of the Se-Te photosensitive member.

In addition, the photosensitive members obtained in Examples 15 and 16 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As and Se-Te photosensitive members.

EXAMPELS 17 AND 18

Surface protective layer of the present invention for a photosensitive member were produced using a glow discharge decomposition device as shown in FIG. 3.

First the interior of the reactor 733 was evacuated to a high vacuum of approximately $10^{-6}$ torr, and the first, second and third regulator valves 707, 708 and 709 were thereafter opened to introduce hydrogen gas from the first tank 701, acetylene gas from the second tank 702, and nitrogen gas from the third tank 703 into the first second and third flow controllers 713, 714 and 715, respectively, each at an output pressure of 1.0 kg/cm$^2$. The dials on the flow controllers were adjusted to supply the hydrogen gas at a flow rate of 250 sccm, the acetylene gas at 200 sccm, and the nitrogen gas at 200 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate measuring 80 mm in diameter and 329 mm in length and having an Se-As photosensitive layer (Example 17) or an Se-Te photosensitive layer (Example 18) previously formed thereon to a film thickness of approximately 50 μm in accordance with conventional methods and using a separate vacuum evaporation device. The temperature of substrate 752 was raised from room temperature to 80° C. over about a 20 min period prior to the introduction of the gases. With the gas flow rates and the pressure in stabilized states, 250-watt power with a frequency of 13.56 MHz was applied to the power application electrode 736 from the high-frequency power source 739 pre-connected thereto by the selecting switch 744 to conduct plasma polymerization for approximately 15 min, forming an a-C layer, i.e., a surface protective layer, 0.7 μm in thickness on the substrate 752. After completion of the film formation, the power supply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over a 25 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layers thus obtained were found to contain 43 atomic % of hydrogen atoms based on the combined amount of hydrogen and carbon atoms, and under Auger analysis the layers were found to contain 1.3 atomic % of nitrogen atoms based on the atoms of the entire structure.

Characteristics

The surfaces of the photosensitive members obtained in Example 17 and Example 18 had hardnesses of 7H and greater based on measurements for pencil lead hardness as provided in Japanese Industrial Standards JIS K-5400, and it is understood that the high degree of hardness was achieved via the surface protective layer of the photosensitive member of the present invention.

Furthermore, when the photosensitive member obtained in Example 17 was measured for white light sensitivity using the normal Carlson process, the amount of light required for light decay was 1.1 lux-sec, and since the measured value prior to the manufacture of the surface protective layer was about 0.96 lux-sec, it is understood that the surface protective layer of the photosensitive member of the present invention does not impair the inherent sensitivity of the Se-As photosensitive member. Also, the photosensitive member obtained in Example 18 was measured for photosensitivity at 780 nm using the normal Carlson process, the amount of light required for light decay being about 5.5 erg/cm$^2$, and since the measured value prior to the manufacture of the surface protective layer was about 5.3 erg/cm$^2$, it is understood that the photosensitive member surface protective layer of the present invention does not impair the inherent sensitivity of the Se-Te photosensitive member.

In addition, the photosensitive members obtained in Examples 17 and 18 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As and Se-Te photosensitive members.

When the photosensitive member obtained in Example 17 was installed in a Minolta Model EP650Z copy machine and copies made, clear images were obtained without a single instance of so-called memory image, and so-called image drift was not observed when copies were made under environmental conditions of 35° C. temperature and 80% humidity. Neither was any separation of the surface protective layer noted when said layer came into contact with the developer, copy paper, and cleaning components within the copy machine. Under normal room conditions, 250,000 copies were made and clear images were obtained to the last. Additionally, after making the 250,000 copies, the surface was subjected to component analysis using Auger analysis, and neither selenium nor arsenic were detected. From these results it can be understood that the photosensitive member surface protective layer of the present invention improved the harmful aspects and increased durability while it did not impair image quality.

When the photosensitive member obtained in Example 18 was installed in a Minolta Model EP450Z copy machine and copies made using an optical system modified to a conventional semiconductor laser exposure system comprising a semiconductor laser, polygon mirror scanner, drive system, and the like, clear images were obtained without a single instance of so-called memory image, and so-called image drift was not observed when copies were made under environmental conditions of 35° C. temperature and 80% humidity. Neither was any separation of the surface protective layer noted when said layer came into contact with the developer, copy paper, and cleaning components within the copy machine. Under normal room conditions, 200,000 copies were made and clear images were obtained to the last. Additionally, after making the 200,000 copies, the surface was subjected to component analysis using Auger analysis, and neither selenium, tellurium, or the like was detected. From these results it can be understood that the photosensitive member surface protective layer of the present invention eliminated the harmful aspects and increased durability while it did not impair image quality.

EXAMPLES 19 AND 20

Surface protective layers of the present invention for photosensitive members were produced using a glow discharge decomposition device as shown in FIG. 3.

First the interior of the reactor 733 was evacuated to a high vacuum of approximately $10^{-6}$ torr, and the first and third regulator valves (707 and 709) were thereafter opened to introduce argon gas from the first tank 701, and ethylene gas from the third tank 703 into the first and third flow controllers 713 and 715, respectively, each at an output pressure of 1.0 kg/cm$^2$. At the same time, the seventh and eighth controller valves 725 and 726 were opened, and styrene gas from the first container 719, with the first heater 722 temperature at 60° C., and aniline gas from the second container 720, with the second heater 723 temperature at 120° C., were fed to the seventh and eighth flow controllers 728 and 729, respectively. The dials on the flow controllers were adjusted to supply the argon gas at a flow rate of 200 sccm, the ethylene gas at 150 sccm, the styrene gas at 100 sccm, and the aniline gas at 60 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer (Example 19) or an Se-Te photosensitive layer (Example 20) previously formed thereon to a film thickness of approximately 50 μm in accordance with conventional methods and using a separate vacuum evaporation device. The temperature of substrate 752 was raised from room temperature to 80° C. over about a 20 min period prior to the introduction of the gases. With the gas flow rates and the pressure in stabilized states, 100-watt power with a frequency of 30 KHz was applied to the power application electrode 736 from the low-frequency power source 741 pre-connected thereto by the selecting switch 744 to conduct plasma polymerization for approximately 10 min, forming an a-C layer, i.e., a surface protective layer, 3.3 μm in thickness on the substrate 752. After completion of the film formation, the power supply was discontinued, the regulator valves were closed with the exception of the argon gas valve, argon gas alone was fed into the reactor 733 at 600 sccm, a pressure of 10 torr was maintained, and the temperature was reduced to 50° C. over about a 15 min period. Thereafter, the argon gas regulator valve was closed, the reactor 733 was fully exhausted, and the substrate temperature was further reduced to 30° C., whereupon the vacuum was broken in reactor 733, and the photosensitive members having the surface protective layers of the present invention were removed.

When subjected to CHN quantitative analysis, the a-C layers thus obtained were found to contain 37 atomic % of hydrogen atoms based on the combined amount of hydrogen and carbon atoms, and under Auger analysis the layers were found to contain 6.8 atomic % of nitrogen atoms based on the atoms of the entire structure.

Characteristics

The surfaces of the obtained photosensitive members in both Examples 19 and 20 had hardnesses of approximately 7H based on measurements for pencil lead hardness as provided in Japanese Industrial Standards JIS K-5400, and it is understood that the high degree of hardness was achieved via the photosensitive member surface protective layer of the present invention.

Furthermore, when the photosensitive member of Example 19 was measured for white light sensitivity using the normal Carlson process, the amount of light required for light decay was 1.15 lux-sec, and since the measured value prior to the manufacture of the surface protective layer was about 0.96 lux-sec, it is understood that the photosensitive member surface protective layer of the present invention does not impair the inherent sensitivity of the Se-As photosensitive member. Also, the photosensitive member obtained in Example 20 was measured for photosensitivity at 780 nm using the normal Carlson process, the amount of light required for light decay being about 5.5 erg/cm$^2$, and since the measured value prior to the manufacture of the surface protective layer was about 5.3 erg/cm$^2$, it is understood that the photosensitive member surface protective layer of the present invention does not impair the inherent sensitivity of the Se-Te photosensitive member.

In addition, the photosensitive members of Examples 19 and 20 were exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive members of Examples 19 and 20 were installed in a copy machine and copies made as per Examples 17 and 18, superior image, adhesive properties, ambience resistance, durability and non-polluting characteristics were confirmed.

EXAMPLE 21

A surface protective layer of the present invention for a photosensitive member was produced using a glow discharge decomposition device as shown in FIG. 3.

First the interior of the reactor 733 was evacuated to a high vacuum of approximately $10^{-6}$ torr, and the first and third regulator valves (707 and 709) were thereafter opened to introduce argon gas from the first tank 701, and butadiene gas from the third tank 703 into the first and third flow controllers 713 and 715, respectively, each at an output pressure of 1.0 kg/cm$^2$. At the same time, the seventh controller valve 725 was opened, and pyridine gas from the first container 719 was fed to the seventh flow controller 728 at a temperature of 40° C. as heated by the first heater 722. The dials on the flow controllers were adjusted to supply the argon gas at a flow rate of 200 sccm, the butadiene gas at 150 sccm, and the pyridine gas at 150 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 180° C. over about a 30 min period prior to the introduction of the gases. With the gas flow rates and the pressure in stabilized states, 150-watt power with a frequency of 30 KHz was applied to the power application electrode 736 from the low-frequency power source 741 pre-connected thereto by the selecting switch 744 to conduct plasma polymerization for approximately 10 min, forming an a-C layer, i.e., a surface protective layer, 2.4 μm in thickness on the substrate 752. After completion of the film formation, the power supply was discontinued, the regulator valves were closed with the exception of the argon gas valve, argon gas alone was fed into the reactor 733 at 600 sccm, a pressure of 10 torr was maintained, and the temperature was reduced to 50° C. over about a 30 min period. Thereafter, the argon gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 52 atomic % of hydrogen atoms based on the combined amount of hydrogen and carbon atoms, and under Auger analysis the layer was found to contain 7 atomic % of nitrogen atoms based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the photosensitive member surface protective layer of the present invention.

Furthermore, when measured for white light sensitivity using the normal Carlson process, the amount of light required for light decay was 1.1 lux-sec, and since the measured value prior to the manufacture of the surface protective layer was about 0.92 lux-sec, it is understood that the photosensitive member surface protective layer of the present invention does not impair the inherent sensitivity of the Se-As photosensitive member.

In addition, the photosensitive member was exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 17, superior image, adhesive properties, ambience resistance, durability and non-polluting characteristics were confirmed.

EXAMPLE 22

A surface protective layer of the present invention for a photosensitive member was produced using a glow discharge decomposition device as shown in FIG. 3.

First the interior of the reactor 733 was evacuated to a high vacuum of approximately $10^{-6}$ torr, and the first and third regulator valves (707 and 709) were thereafter opened to introduce hydrogen gas from the first tank 701, and ammonia gas from the third tank 703 into the first and third flow controllers 713 and 715, respectively, each at an output pressure of 1.0 kg/cm$^2$. At the same time, the seventh controller valve 725 was opened, and myrcene gas from the first container 719 was fed to the seventh flow controller 728 at a temperature of 85° C. as heated by the first heater 722. The dials on the flow controllers were adjusted to supply the hydrogen gas at a flow rate of 50 sccm, the ammonia gas at 10 sccm, and the myrcene gas at 100 sccm, to the reactor 733 through the main pipe 732 via the intermediate mixer 731. Following stabilization of each gas flow, the internal pressure of the reactor 733 was adjusted to 1.0 torr by the pressure control valve 745. On the other hand, the substrate 752 was used, said substrate being an aluminum substrate having a diameter of 80 mm and a length of 329 mm, and having an Se-As photosensitive layer previously formed thereon to a film thickness of approximately 50 μm in accordance with conventional methods and using a separate vacuum evaporation device. The temperature of substrate 752 was raised from room temperature to 200° C. over about a 30 min period prior to the introduction of the gases. With the gas flow rates and the pressure in stabilized states, 120-watt power with a frequency of 45 KHz was applied to the power application electrode 736 from the low-frequency power source 741 pre-connected thereto by the selecting switch 744 to conduct plasma polymerization for approximately 10 min, forming an a-C layer, i.e., a surface protective layer, 4.1 μm in thickness on the substrate 752. After completion of the film formation, the power supply was discontinued, the regulator valves were closed with the exception of the hydrogen gas valve, hydrogen gas alone was fed into the reactor 733 at 600 sccm, a pressure of 10 torr was maintained, and the temperature was reduced to 50° C. over about a 30 min period. Thereafter, the hydrogen gas regulator valve was closed, the reactor 733 was fully exhausted, and the substrate temperature was further reduced to 30° C., whereupon the vacuum was broken in reactor 733, and the photosensitive member having the surface protective layer of the present invention was removed.

When subjected to CHN quantitative analysis, the a-C layer thus obtained was found to contain 36 atomic % of hydrogen atoms based on the combined amount of hydrogen and carbon atoms, and under Auger analysis the layer was found to contain 0.2 atomic % of nitrogen atoms, based on the atoms of the entire structure.

Characteristics

The surface of the obtained photosensitive member had a hardness of approximately 7H based on measurements for pencil lead hardness as provided in Japanese Industrial Standards JIS K-5400, and it is understood that the high degree of hardness was achieved via the photosensitive member surface protective layer of the present invention.

Furthermore, when measured for white light sensitivity using the normal Carlson process, the amount of light required for light decay was 0.91 lux-sec, and since the measured value prior to the manufacture of the surface protective layer was about 0.9 lux-sec, it is understood that the photosensitive member surface protective layer of the present invention does not impair the inherent sensitivity of the Se-As photosensitive member.

In addition, the photosensitive member was exposed to atmospheric conditions of low temperature-low humidity (10° C. and 30% humidity) and high temperature-high humidity (50° C. and 90% humidity) which were alternated every 30 min each over a six hour period, and cracking or separation of the surface protective layer was not observed, from which results it is understood that the photosensitive member surface protective layer of the present invention has superior adhesive properties regarding its adhesion to the Se-As photosensitive member.

When the photosensitive member was installed in a copy machine and copies made as per Example 17, superior image, adhesive properties, ambience resistance, durability and nonpolluting characteristics were confirmed.

COMPARATIVE EXAMPLES 7 AND 8

Overcoat layers were formed on an Se-As photosensitive member (Comparative Example 7) and an Se-Te photosensitive member (Comparative Example 8) as per Examples 17 and 18 except the inflow of nitrogen gas was omitted.

When Auger analysis was performed on these overcoat layers, nitrogen atoms were not detected, for example, although extremely minute quantities of nitrogen atoms contaminated the layers, said quantities are understood to be below the detection limits of Auger analysis of 0.1 atomic %.

Many characteristics showed values resembling those of Examples 17 and 18, but when these photosensitive members were installed in copy machines and continuous copy operations performed, so-called memory images were produced wherein a previous image appears as a negative on a subsequent image, and suitable images were not obtained under these actual field conditions. From these results it is understood that electrical conformity was improved by the addition of nitrogen atoms with the result that image quality was also improved.

After completion of the field tests, the photosensitive members obtained in Comparative Examples 7 and 8 were exposed to atmospheric conditions of low temperature-low humidity (10° C. and 30% humidity) and high temperature-high humidity (50° C. and 90% humidity) which were alternated every 30 min each over a six hour period, with the result that the surface protective layers gradually separated from the edges of the drum-shaped photosensitive members and eventually separated from the entire drum surface along with the appearance of cracks in said layer surface, and from which results it is understood that the photosensitive member surface protective layer of the present invention had improved adhesion properties vis-a-vis the Se-As and Se-Te photosensitive members via the addition of nitrogen.

COMPARATIVE EXAMPLES 9 AND 10

Overcoat layers were formed on an Se-As photosensitive member (Comparative Example 9) and an Se-Te photosensitive member (Comparative Example 10) as per Examples 19 and 20 except the inflow of aniline gas was omitted.

When Auger analysis was performed on these overcoat layers, nitrogen atoms were not detected, for example, although extremely minute quantities of nitrogen atoms contaminated the layers, said quantities are understood to be below the detection limits of Auger analysis of 0.1 atomic %.

Many characteristics showed values resembling those of Examples 19 and 20, but when these photosensitive members were installed in copy machines and continuous copy operations performed, so-called memory images were produced wherein a previous image appears as a negative on a subsequent image, and suitable images were not obtained under these actual field conditions. From these results it is understood that electrical conformity was improved by the addition of nitrogen atoms with the result that image quality was also improved.

After completion of the field tests, the photosensitive members obtained in Comparative Examples 9 and 10 were exposed to atmospheric conditions of low temperature-low humidity (10° C. and 30% humidity) and high temperature-high humidity (50° C. and 90% humidity) which were alternated every 30 min each over a six hour period, with the result that the surface protective layers separated from the entire surface of the respective photosensitive members, and from which results it is understood that the photosensitive member surface protective layer of the present invention had improved adhesion properties vis-a-vis the Se-As and Se-Te photosensitive members via the addition of nitrogen.

What is claimed is:

1. A photosensitive member comprising:

an electrically conductive substrate;

a photoconductive layer comprising a selenium-arsenic alloy layer or comprising a selenium layer and a selenium-tellurium layer formed in that order; and an overcoat layer formed on said photoconductive layer and comprising amorphous carbon containing hydrogen, said overcoat layer containing one kind of atom selected from the group consisting of halogen, oxygen and nitrogen.

2. A photosensitive member as claimed in claim 1 wherein the amount of said hydrogen contained in said overcoat layer is about 30 to 60 atomic % based on the combined amount of hydrogen and carbon therein.

3. A photosensitive member as claimed in claim 2 wherein halogen atoms are contained in said overcoat layer in an amount of about 0.1 to about 50 atomic % based on all the constituent atoms therein.

4. A photosensitive member as claimed in claim 2 wherein oxygen atoms are contained in said overcoat layer in an amount of about 0.1 to about 10 atomic % based on all the constituent atoms therein.

5. A photosensitive member as claimed in claim 2 wherein nitrogen atoms are contained in said overcoat layer in an amount of about 0.1 to about 10 atomic % based on all the constituent atoms therein.

6. A photosensitive member as claimed in claim 1 wherein said overcoat layer is prepared by organic plasma polymerization.

7. A photosensitive member as claimed in claim 1 wherein the thickness of the overcoat layer is about 0.2 to about 5 microns.

8. A photosensitive member comprising:

an electrically conductive substrate;

a photoconductive layer comprising a selenium-arsenic alloy layer or comprising a selenium layer and a selenium-tellurium layer formed in that order; and an overcoat layer formed on said photoconductive layer and comprising amorphous carbon containing hydrogen in an amount of about 30 to about 60 atomic % based on the combined amount of hydrogen and carbon, said overcoat layer containing about 0.1 to about 50 atomic % of halogen or about 0.1 to about 7 atomic % of oxygen or about 0.1 to about 5 atomic % of nitrogen based on all the constituent atoms therein.

* * * * *